US006378172B1

(12) United States Patent
Schrage

(10) Patent No.: US 6,378,172 B1
(45) Date of Patent: Apr. 30, 2002

(54) AIRPLANE CONTAINER DOOR HINGE

(75) Inventor: Bernard J. Schrage, Cincinnati, OH (US)

(73) Assignee: Fabri-Craft, Inc., Walton, KY (US)

( * ) Notice: Subject to any disclaimer, the term of this patent is extended or adjusted under 35 U.S.C. 154(b) by 0 days.

(21) Appl. No.: 09/723,923

(22) Filed: Nov. 28, 2000

Related U.S. Application Data

(60) Provisional application No. 60/222,364, filed on Aug. 1, 2000.

(51) Int. Cl.[7] ..... E05D 3/06; E05D 11/06

(52) U.S. Cl. ..... 16/366; 16/374; 16/225; 160/199; 160/229.1

(58) Field of Search ..... 16/366, 374, 225, 16/DIG. 13, DIG. 1; 160/187, 199, 206, 229.1, 235, 231.2

(56) References Cited

U.S. PATENT DOCUMENTS

| | | | | | |
|---|---|---|---|---|---|
| 2,978,020 | A | | 4/1961 | Paulsrude | |
| 3,353,884 | A | * | 11/1967 | Chaffee et al. | 16/225 |
| 3,441,975 | A | * | 5/1969 | Shepherd | 16/225 |
| D217,232 | S | | 4/1970 | Meller et al. | |
| 3,516,114 | A | * | 6/1970 | Joyce, 3rd | 16/225 |
| 3,570,579 | A | | 3/1971 | Matsushima | |
| 3,645,596 | A | | 2/1972 | Russell-French | |
| 3,672,529 | A | | 6/1972 | Feddersen et al. | |
| 3,860,138 | A | | 1/1975 | Lovich et al. | |
| 3,881,221 | A | * | 5/1975 | Schmidt | 16/273 |
| 4,008,936 | A | | 2/1977 | Meller et al. | |
| 4,127,214 | A | | 11/1978 | Pedraza | |
| 4,438,605 | A | | 3/1984 | DeLucia | |
| 4,747,504 | A | | 5/1988 | Wiseman et al. | |
| 4,777,777 | A | * | 10/1988 | Massimo | 16/225 |
| 4,823,531 | A | | 4/1989 | Labelle | |
| 4,968,171 | A | * | 11/1990 | Shell | 16/224 |
| 5,148,850 | A | * | 9/1992 | Urbanick | 16/225 |
| 5,170,832 | A | * | 12/1992 | Wagner | 160/201 |
| 5,588,180 | A | * | 12/1996 | Chester | 16/225 |

* cited by examiner

*Primary Examiner*—Chuck Y. Mah
(74) *Attorney, Agent, or Firm*—Wood, Herron & Evans, L.L.P.

(57) ABSTRACT

A hinge for joining two adjacent panels. The hinge comprises a first piece adapted to receive a first panel, a second piece adapted to receive a second panel, and a middle piece. Each of the first and second pieces has an opening for receiving a panel and a socket defined between two spaced stopping surfaces. Portions of the middle piece are received within the sockets of the first and second hinge pieces. The configuration of the hinge pieces prevents the panels from folding in one direction while enabling the panels to fold together in the other direction.

7 Claims, 5 Drawing Sheets

AIRPLANE CONTAINER DOOR HINGE

This Application claims benefit of No. 60/222,364 Aug. 1, 2000.

FIELD OF THE INVENTION

This invention relates to a hinge for securing two adjacent door panels of an airplane cargo container so that the panels may fold in one direction only and end up parallel to one another.

BACKGROUND OF THE INVENTION

Airplane cargo containers specifically configured to fit inside the fuselage of an airplane have been used for years. U.S. Pat. No. 4,747,504 assigned to Airborne Express, Inc. discloses one such aircraft cargo container. This patent discloses a three-panel door slidably mounted in channels to enable the door to fold in an accordion fashion and be stored above the container when not in use. An upper panel is secured to an intermediate panel with a piano-type hinge, and similarly the intermediate panel is secured to a lower panel with another piano-type hinge. The piano-type hinges are located on opposite sides of the door. The door panels may be folded upon one another in order to fully open, partially open, or close an opening at the front of the container. However, these piano-type hinges are not structurally strong enough to withstand common loads placed upon the door which may be up to 2000 pounds of pressure. Additionally, these piano-type hinges are expensive to apply to the door because they require many rivets applied to the panels of the door. Thus, to apply a piano-type hinge to a door panel is very labor intensive. Additionally, the rivets used to secure the piano-type hinges to the door panels may wear over time, causing the hinges to be easily torn off the door panels.

Consequently, it is one objective of the present invention to provide a hinge for use with container doors which will withstand large loads.

It is a further objective of the present invention to provide a hinge which enables two door panels to fold in one direction only.

It is a further objective of the present invention to provide a hinge which connects two door panels without the use of rivets.

SUMMARY OF THE INVENTION

The invention of this application which accomplishes these objectives comprises a hinge for joining two adjacent door panels. The hinge may be used in many other applications and is not intended to be limited to use with airplane container door panels.

The hinge comprises a first piece adapted to receive a first door panel, a second piece adapted to receive a second door panel, and a middle piece joining the first and second pieces so that the first and second pieces, along with their respective panels, can only be folded in one direction. Each of the first and second pieces has an opening for receiving a door panel and a socket defined between two spaced stopping surfaces. The openings may be any size or configuration in order to receive panels of different thicknesses and configurations. Each of the stopping surfaces is essentially planar and extends the width of the door panel to which the piece is attached.

The middle piece has a pair of cylindrical sections at the outer ends of arms extending radially outward from a central section of the middle piece. Each of the arms has an outer surface and an inner surface. One of the cylindrical sections of the middle piece of the hinge is received within the socket of the first piece of the hinge. The other of the cylindrical sections of the middle piece of the hinge is received within the socket of the second piece of the hinge. Each of the cylindrical sections has a circular cross sectional configuration.

Interengagement of the stopping surfaces of the first and second pieces of the hinge with the arms of the middle piece of the hinge prevents the door panels from folding in one direction but enables the door panels to fold in the other direction together so that they are substantially parallel (side by side). The stopping surfaces of the first and second pieces of the hinge abut the outer surface of the arms of the middle piece of the hinge when the panels are opened, thus preventing the door panels from folding in one direction while enabling the door panels to fold in the other direction. When the door panels are closed or folded together, the stopping surfaces of the first and second pieces of the hinge abut an inner surface of the arms of the middle piece of the hinge.

BRIEF DESCRIPTION OF THE DRAWINGS

FIG. 3A is a view taken along the line 3A—3A of FIG. 1, illustrating the door in a closed position.

FIG. 3B illustrates the door in a partially closed position.

FIG. 3C illustrates the door in an open position.

DETAILED DESCRIPTION OF THE INVENTION

Figure 1:
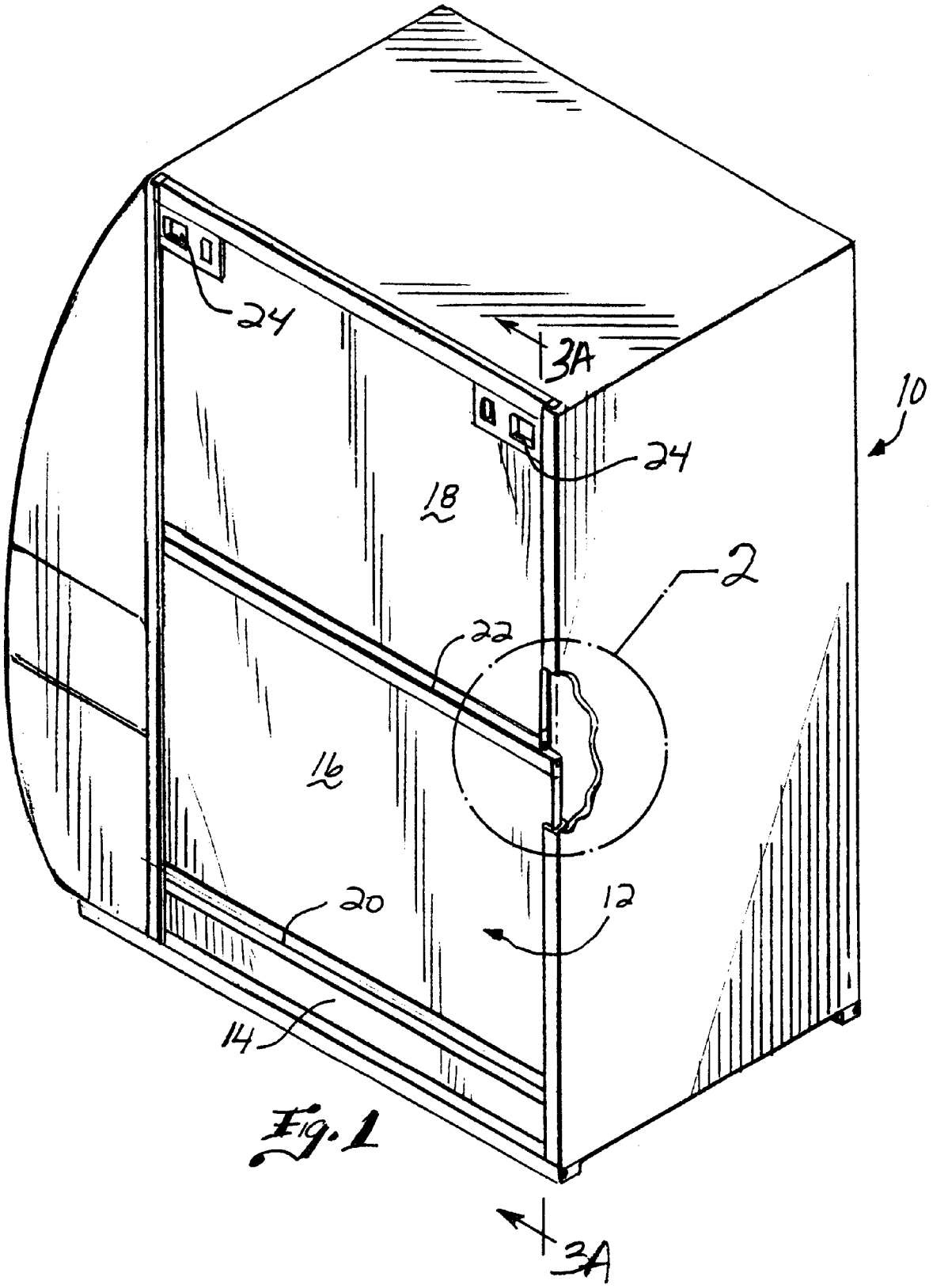
FIG. 1 is a perspective view of a airplane cargo container having a three-panel door equipped with the hinge of the present invention.

Referring to the drawings, and particularly to FIG. 1, there is illustrated an airplane cargo container 10 having a door 12. The door 12 comprises a bottom panel 14, a middle panel 16, and a top panel 18, connected together with a pair of hinges 20, 22. The first hinge 20 connects the bottom and middle panels 14, 16 together. The second hinge 22 connects the intermediate and top panels 16, 18 together. The top panel 18 has a pair of latches 24 which function to lock the door in a closed position as illustrated in FIG. 1.

Figure 2:
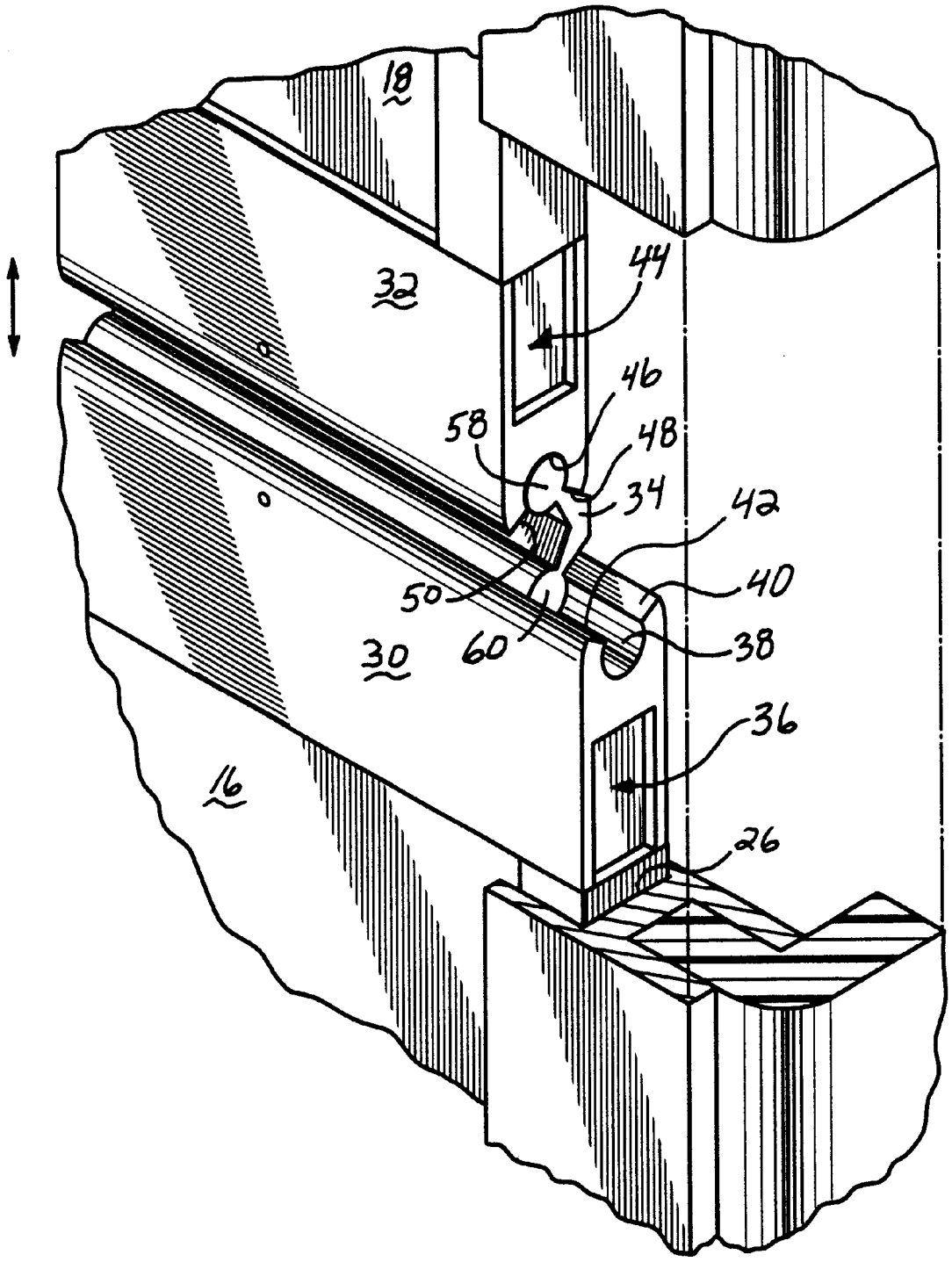
FIG. 2 is an enlarged view of the encircled area 2 of FIG. 1.

Referring now to FIG. 2, the hinge 22 will be described in detail. The hinge 22 joins the middle panel 16 to the top panel 18. As illustrated in FIG. 2, each of the panels is adapted to slide inside a track 26 in the direction of arrow 27, as will be described in more detail below. The hinge 22 is made up of three pieces: a first piece 30, a second piece 32 and a middle piece 34. The middle piece 34 is sometimes referred to as a "dog bone" due to its configuration.

The first piece 30 of the hinge 22 has an opening 36 adapted to receive a portion of the middle door panel 18. Additionally, the first piece 30 of the hinge 22 has a socket 38 defined between two spaced stopping surfaces 40 and 42. Each stopping surface 40,42 is generally planar and extends the width of the first hinge piece 30.

Similarly, the second piece 32 of the hinge 22 has an opening 44 for receiving a portion of the top panel 18 and a socket 46 defined between generally planar stopping surfaces 48 and 50. As illustrated in FIG. 2, the width of the first piece 30 of the hinge 22 is greater than the width of the second piece 32 of the hinge 22 to enable the top door panel 18 to fold downwardly from the position illustrated in FIG. 3A to the position illustrated in FIG. 3B. See arrow 33 of FIG. 3A.

Figure 4A:
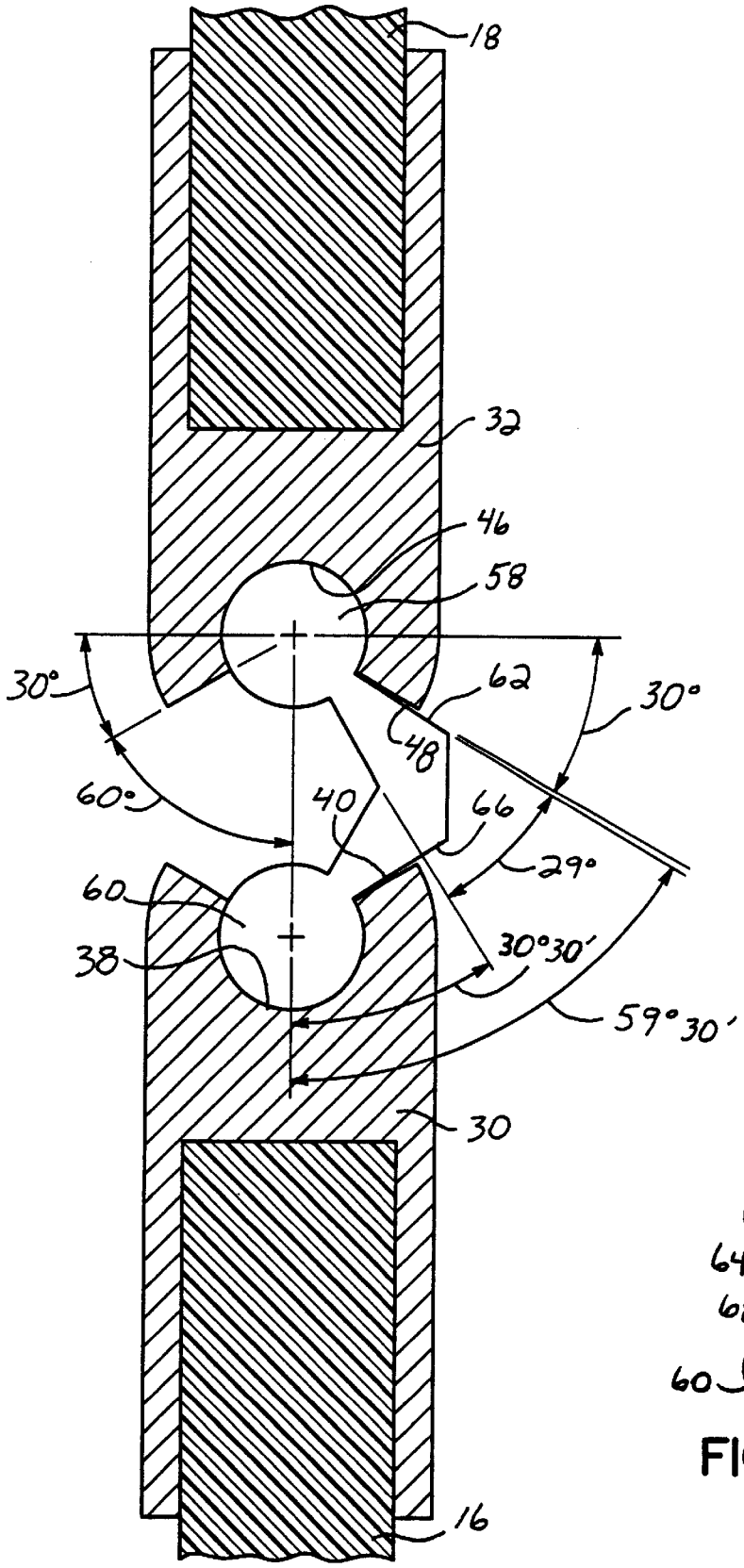
FIG. 4A is a side view of the three-part hinge of the present invention
Figure 4B:
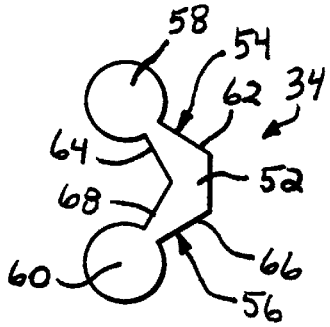
FIG. 4B is a side view of the middle section of the three-part hinge of the present invention.

As best illustrated in FIG. 4B, the last piece of the hinge 22 is a middle piece 34 which has a central section 52, a pair of arms 54,56 extending outwardly from the central section 52, and a pair of outermost cylindrical sections 58,60 at the outer ends of arms 54,56, respectively. Arm 54 has an outer surface 62 and an inner surface 64. Similarly, arm 56 has an outer surface 66 and an inner surface 68.

Figure 3A:
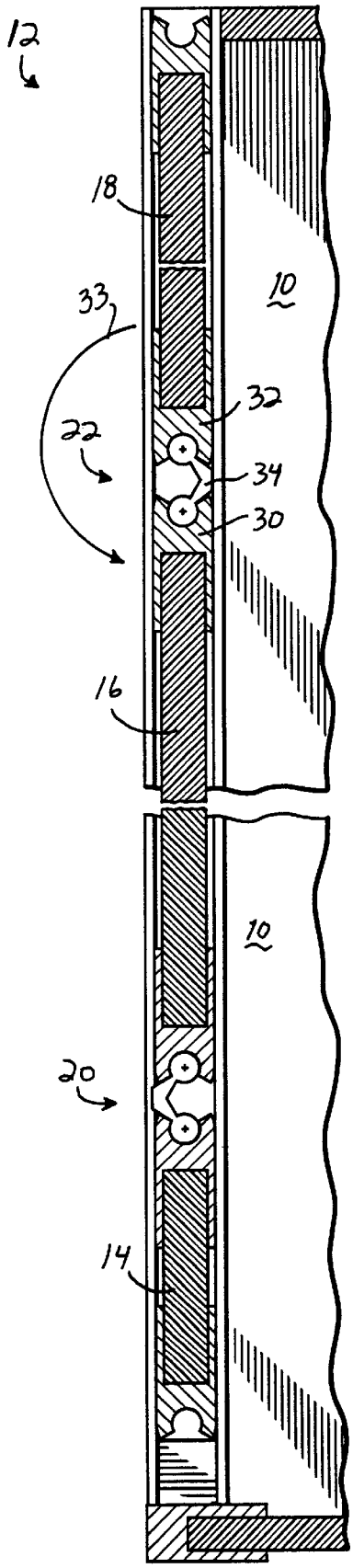
FIGS. 3A–3C illustrate the process of opening the hinged container door of FIG. 1.

As illustrated in FIGS. 2 and 4A, the cylindrical sections 60, 58 of the middle piece 34 of the hinge 22 are received within the sockets 38,46 of the second and first pieces 30, 32 of the hinge, respectively. When the door panels 16, 18 are generally co-planar and the hinge 22 is open the stopping surface 40 of the first piece 30 of the hinge 22 abuts the outer surface 66 of the arm 56 of the middle piece 34 of the hinge 22. Similarly, the stopping surface 48 of the second piece 32 of the hinge 22 abuts the outer surface 62 of the arm 54 of the middle piece 34 of the hinge 22, thus preventing the door panels 16, 18 from folding upon one another in one direction while yet enabling the two panels 16, 18 to fold upon one another in the other direction, the direction of arrow 33 illustrated in FIG. 3A.

Figure 3B:
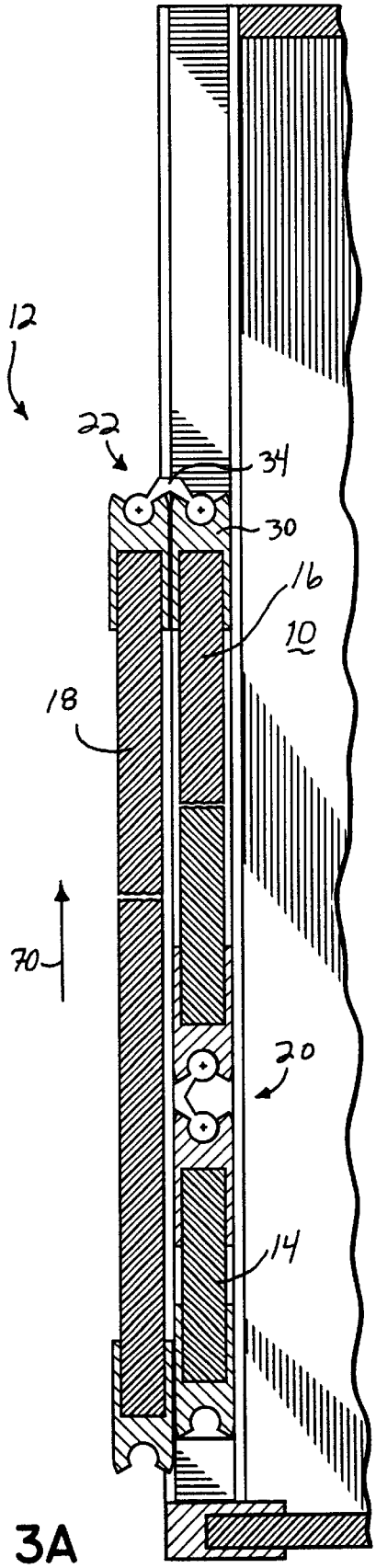

As illustrated in FIG. 3B, the stopping surface 42 of the first piece 30 of the hinge 22 abuts the inside surface 68 of the arm 56 of the middle piece 34 of the hinge 22 when the top door panel 18 is folded downwardly into the position shown in FIG. 3B. Similarly, the stopping surface 50 of the second piece 32 of the hinge 22 abuts the inside surface 64 of the arm 54 of the middle piece 34 of the hinge 22.

In order for the hinge of the present invention to function properly the angles illustrated in FIG. 4A must be maintained.

Figure 3C:
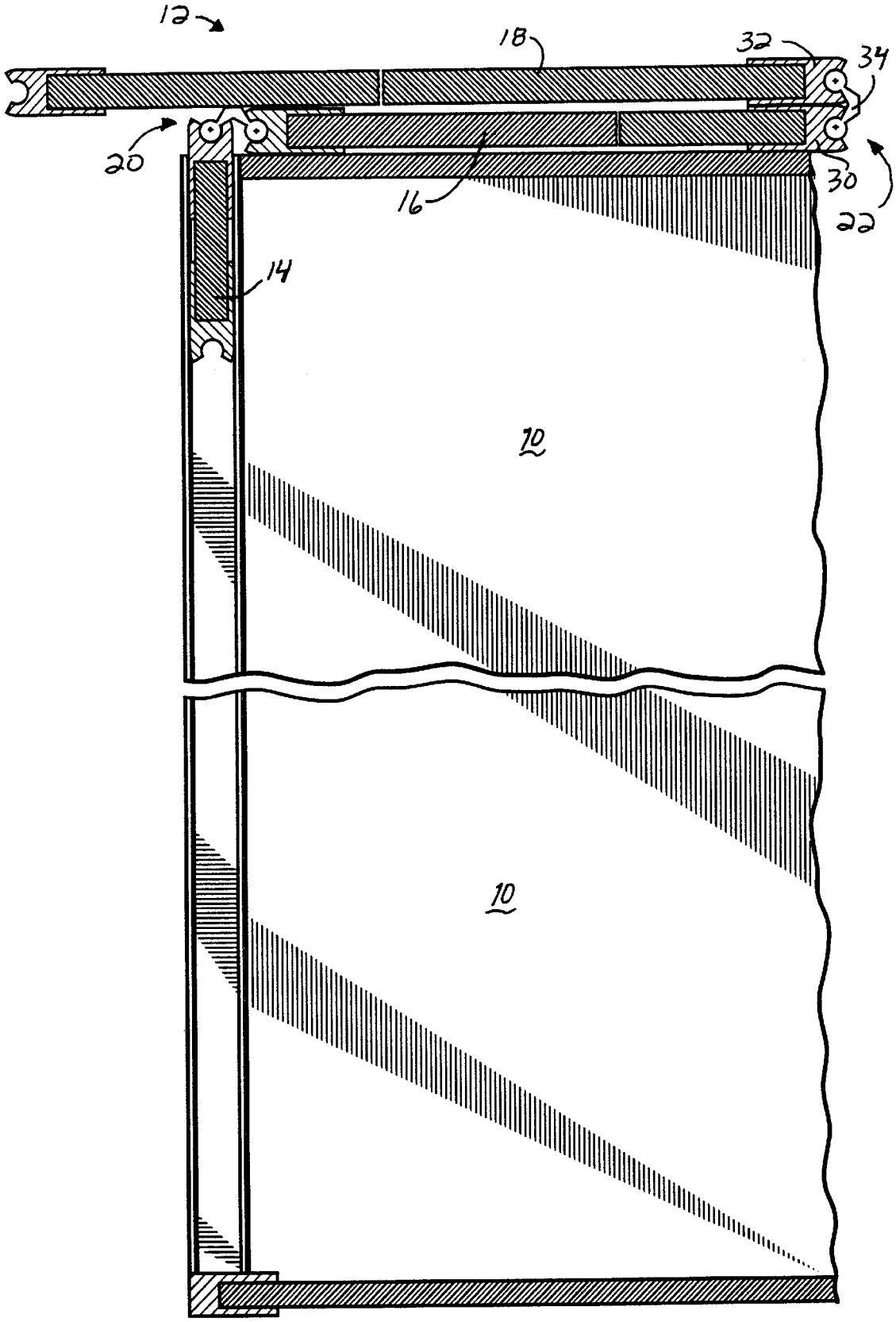

Referring to FIGS. 3A–3C, the method of opening the container door 12 will be briefly described. The user first opens the latches 24 on the top panel 18 of the door and folds the top panel 18 from the position illustrated in FIG. 3A to the position illustrated in FIG. 3B. The door 12 is then slide upwardly in track 26 in the direction of arrow 70 until only the bottom panel 20 is in the track 26. Due to the opposite orientations of the hinges 20, 22, the top and middle panels 18, 16 may fold together as shown in FIG. 3C and rest on top of the container 10.

Although a detailed description of one preferred embodiment of the present invention has been described above, those of ordinary skill in the art will appreciate changes and modifications which may be made to the present invention without departing from the spirit and scope of the present invention. It is therefore, applicant's intention to be bound only by the scope of the following claims and not to the detailed specifics provided in the above specification.

Therefore, I claim:

1. A hinge for joining two panels of a door, said hinge comprising:

a first piece adapted to receive a first panel, said first piece having a socket defined between two spaced stopping surfaces, a second piece adapted to receive a second panel, said second piece having a socket defined between two spaced stopping surfaces, and a middle piece having a pair of cylindrical sections at outer ends of arms extending outwardly from a central section of said middle piece, one of said cylindrical sections being received within said socket of said first piece and the other of said cylindrical sections being received within said socket of said second piece wherein interengagement of said stopping surfaces of said first and second pieces of said hinge with said middle piece of said hinge prevents said door panels from folding in one direction while enabling said door panels to fold together in the other direction.

2. The hinge of claim 1 wherein said hinge is aluminum.

3. The hinge of claim 1 wherein said hinge is extruded.

4. The hinge of claim 1 wherein said middle piece of said hinge may be removed and rotated 180 degrees causing said door panels to only fold in an opposite direction than the direction set forth in claim 1.

5. A hinge for joining two adjacent door panels, said hinge comprising:

a first piece adapted to receive a first door panel, said first piece having an opening for receiving said first door panel and a socket defined between two spaced stopping surfaces, a second piece adapted to receive a second panel, said second piece having an opening for receiving said second panel and a socket defined between two spaced planar stopping surfaces, and a middle piece having a pair of cylindrical sections at outer ends of arms extending outwardly from a central section of said middle piece, one of said cylindrical sections being received within said socket of said first piece and the other of said cylindrical sections being received within said socket of said second piece wherein said one of said stopping surfaces of said first and second pieces of said hinge abuts an outer surface of said arms of said middle piece of said hinge when said panels are generally parallel preventing said door panels from folding in one direction while enabling said door panels to fold in the other direction.

6. The hinge of claim 5 wherein said hinge pieces are made of extruded aluminum.

7. The hinge of claim 5 wherein one of said stopping surfaces of said first and second pieces of said hinge abuts an inner surface of said arms of said middle piece of said hinge when said panels are folded together.

* * * * *